US010036244B2

(12) United States Patent
Rayssiguier et al.

(10) Patent No.: US 10,036,244 B2
(45) **Date of Patent: *Jul. 31, 2018**

(54) ACOUSTIC TRANSCEIVER WITH ADJACENT MASS GUIDED BY MEMBRANES

(71) Applicant: Schlumberger Technology Corporation, Sugar land, TX (US)

(72) Inventors: Christophe M. Rayssiguier, Melun (FR); Benoit Froelich, Marly-le-Roi (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/298,954

(22) Filed: Jun. 8, 2014

(65) Prior Publication Data

US 2014/0286130 A1 Sep. 25, 2014

Related U.S. Application Data

(63) Continuation of application No. 12/644,054, filed on Dec. 22, 2009, now Pat. No. 8,750,075.

(51) Int. Cl.
*E21B 47/16* (2006.01)
*E21B 47/14* (2006.01)
(Continued)

(52) U.S. Cl.
CPC ..... *E21B 47/14* (2013.01); *E21B 47/011* (2013.01); *E21B 47/16* (2013.01); *G10K 11/004* (2013.01); *Y10T 29/49005* (2015.01)

(58) Field of Classification Search
CPC ..... G10K 11/004
(Continued)

(56) References Cited

U.S. PATENT DOCUMENTS 3,980,986 A 9/1976 Baird et al.
3,992,694 A * 11/1976 Ehrlich ..... 367/158
(Continued)

FOREIGN PATENT DOCUMENTS

EP 1882811 A1 1/2008
EP 1887181 A1 2/2008
(Continued)

OTHER PUBLICATIONS

Examination report for the equivalent European patent application No. 10805691.2 dated Sep. 15, 2014.
(Continued)

*Primary Examiner* — Amine Benlagsir
(74) *Attorney, Agent, or Firm* — Cameron R. Sneddon; Marianne Buckley

(57) ABSTRACT

An acoustic transceiver assembly including a housing, an oscillator, and at least one membrane. The housing has at least one inner wall defining a cavity. The housing also has a first end and a second end defining an axis of the acoustic transceiver assembly. The oscillator is provided in the cavity. The oscillator is provided with a transducer element, and a backing mass acoustically coupled to the transducer element. The at least one membrane extends outward from the backing mass to support at least the backing mass within the cavity. The at least one membrane is flexible in an axial direction parallel to the axis of the acoustic transceiver assembly to permit the backing mass to oscillate in the axial direction, and rigid in a transverse direction to restrict lateral movement of the backing mass relative to the housing.

16 Claims, 7 Drawing Sheets

(51) Int. Cl.
*E21B 47/01* (2012.01)
*G10K 11/00* (2006.01)

(58) Field of Classification Search
USPC ..... 367/81, 82
See application file for complete search history.

(56) References Cited

U.S. PATENT DOCUMENTS

| | | | | |
|---|---|---|---|---|
| 4,129,850 | A | 12/1978 | Mumper | |
| 4,282,588 | A | 8/1981 | Chanson et al. | |
| 4,283,779 | A | 8/1981 | Lamel | |
| 4,283,780 | A | 8/1981 | Nardi | |
| 5,148,408 | A | 9/1992 | Matthews | |
| 5,293,937 | A | 3/1994 | Schultz et al. | |
| 5,469,736 | A | 11/1995 | Moake | |
| 5,477,101 | A | 12/1995 | Ounadjela | |
| 5,796,677 | A | 8/1998 | Kostek et al. | |
| 5,798,488 | A | 8/1998 | Beresford et al. | |
| 5,850,369 | A | 12/1998 | Rorden et al. | |
| 5,852,587 | A | 12/1998 | Kostek et al. | |
| 5,886,303 | A | 3/1999 | Rodney | |
| 5,995,449 | A | 11/1999 | Green et al. | |
| 6,084,826 | A | 7/2000 | Leggett, III | |
| 6,137,747 | A | 10/2000 | Shah et al. | |
| 6,310,829 | B1 | 10/2001 | Green et al. | |
| 6,434,084 | B1 | 8/2002 | Schultz | |
| 6,466,513 | B1 | 10/2002 | Pabon et al. | |
| 6,847,585 | B2 | 1/2005 | Macpherson | |
| 6,899,178 | B2 | 5/2005 | Tubel | |
| 7,265,682 | B2 | 9/2007 | Memarzadeh et al. | |
| 7,301,472 | B2 | 11/2007 | Kyle et al. | |
| 7,301,473 | B2 | 11/2007 | Shah et al. | |
| 7,310,473 | B2 | 11/2007 | Shah et al. | |
| 7,324,010 | B2 | 1/2008 | Gardner et al. | |
| 7,339,494 | B2 | 3/2008 | Shah et al. | |
| 7,460,435 | B2 | 12/2008 | Garcia-Osuna et al. | |
| 7,595,737 | B2 | 9/2009 | Fink et al. | |
| 7,777,645 | B2 * | 8/2010 | Shah et al. | 340/855.7 |
| 8,040,249 | B2 | 10/2011 | Shah et al. | |
| 8,570,832 | B2 | 10/2013 | Rayssiguier et al. | |
| 2006/0114746 | A1 | 6/2006 | Gardner et al. | |
| 2007/0158947 | A1 * | 7/2007 | Annen | F02B 63/04 290/1 R |
| 2009/0212475 | A1 * | 8/2009 | Tropf | F16F 15/02 267/75 |
| 2010/0045119 | A1 * | 2/2010 | Jackson | H02K 35/02 310/20 |
| 2010/0309019 | A1 | 12/2010 | Shah et al. | |

FOREIGN PATENT DOCUMENTS

| | | | |
|---|---|---|---|
| EP | 1950586 | A2 | 7/2008 |
| FR | 2739521 | A1 | 4/1997 |
| RU | 2276725 | C2 | 5/2006 |
| WO | 2007/023262 | A1 | 3/2007 |

OTHER PUBLICATIONS

International Search Report and Written Opinion issued in the related PCT application PCT/EP2010/007724, dated May 4, 2011 (16 pages).

International preliminary report on patentability issued in the related PCT application PCT/EP2010/007724, dated Jun. 26, 2012 (10 pages).

Office action issued in the related CA application 2785344, dated Oct. 18, 2016 (3 pages).

Examination Report issued in the related CA Application 2785344, dated Oct. 17, 2017 (4 pages).

* cited by examiner

ACOUSTIC TRANSCEIVER WITH ADJACENT MASS GUIDED BY MEMBRANES

CROSS-REFERENCE TO RELATED APPLICATIONS

This application is a continuation of co-pending U.S. patent application Ser. No. 12/644,054, filed Dec. 22, 2009, now U.S. Pat. No. 8,750,075 which is herein incorporated by reference.

BACKGROUND

Field of the Invention

This invention relates generally to telemetry systems and acoustic sensors for use with installations in oil and gas wells or the like. More particularly, but not by way of limitation, the present invention relates to an acoustic transceiver assembly for transmitting and receiving data and control signals between a location down a borehole and the surface, or between downhole locations themselves.

Description of the Related Art

One of the more difficult problems associated with any borehole is to communicate measured data between one or more locations down a borehole and the surface, or between downhole locations themselves. For example, in the oil and gas industry it is desirable to communicate data generated downhole to the surface during operations such as drilling, perforating, fracturing, and drill stem or well testing; and during production operations such as reservoir evaluation testing, pressure and temperature monitoring. Communication is also desired to transmit intelligence from the surface to downhole tools or instruments to effect, control or modify operations or parameters.

Accurate and reliable downhole communication is particularly important when complex data comprising a set of measurements or instructions is to be communicated, i.e., when more than a single measurement or a simple trigger signal has to be communicated. For the transmission of complex data it is often desirable to communicate encoded analog or digital signals.

One approach which has been widely considered for borehole communication is to use a direct wire connection between the surface and the downhole location(s). Communication then can be made via electrical signal through the wire. While much effort has been spent on "wireline" communication, its inherent high telemetry rate is not always needed and its deployment can pose problems for some downhole operations.

Wireless communication systems have also been developed for purposes of communicating data between a downhole tool and the surface of the well. These techniques include, for example, communicating commands downhole via (1) electromagnetic waves; (2) pressure or fluid pulses; and (3) acoustic communication. Each of these arrangements are highly susceptible to damage due to the harsh environment of oilfield technology in terms of shocks, loads, temperature, pressures, environmental noise and chemical exposure. As such, there is a need in the oil and gas industry to provide protected and reliable wireless communication systems for transmitting data and control signals between a location down a borehole and the surface, or between downhole locations themselves.

In general, a basic element of the conventional acoustic telemetry system includes one or more acoustic transceiver element, such as piezoelectric element(s), magnetostrictive element(s) or combinations thereof which convert energy between electric and acoustic forms, and can be adapted to act as a source or a sensor. In general, one acoustic transceiver element can be made of one or more piezoelectric elements or magnetostrictive element. With respect to the acoustic transceiver element being made from a stack of piezoelectric elements, such elements are made of brittle, ceramic material, thereby requiring protection from transport and operational shocks. Conventional sonic sources and sensors used in downhole tools are described in U.S. Pat. Nos. 6,466,513, 5,852,587, 5,886,303, 5,796,677, 5,469,736 and 6,084,826, 6,137,747, 6,466,513, 7,339,494, and 7,460,435.

In particular, U.S. Pat. No. 7,339,494 teaches an acoustic telemetry transceiver having a piezoelectric transducer for generating an acoustic signal that is to modulate along a mandrel. The prior art is described as providing an acoustic telemetry transceiver that approximately removes lateral movement (relative to the axis of the drill string), and as being configured to be stable over a wide range of operating temperatures and to withstand large shock and vibrations. Embodiments for achieving such objectives teach an acoustic telemetry transceiver having a backing mass that is housed in a linear/journal bearing, and/or a piezoelectric stack coupled to a tapered conical section of the mandrel of the drill string wherein contact is increased therebetween based on a pressure of a flow of a fluid between the piezoelectric stack and the mandrel.

While the present invention and the prior art taught by U.S. Pat. No. 7,339,494 may be considered to share common objectives of protecting the piezoelectric elements of an acoustic transceiver, the exemplary implementations of the present invention, which will be subsequently described in greater detail, for carrying out such objectives include many novel features that result in a new acoustic transceiver assembly and method which is not anticipated, rendered obvious, suggested, or even implied by any of the prior art devices or methods, either alone or in any combination thereof.

Despite the efforts of the prior art, there exists a need for an acoustic transceiver adapted to withstand the heavy shocks and vibrations often associated with the transportation and operation of a downhole tubing string. It is therefore desirable to provide an improved acoustic transceiver assembly with integrated protective features without sacrificing performance and sensitivity.

SUMMARY

In one aspect, the present invention is directed to an acoustic transceiver assembly including a housing, an oscillator and at least one membrane. The housing has at least one inner wall defining a cavity. The housing has a first end and a second end defining an axis of the acoustic transceiver assembly.

The oscillator is provided in the cavity. The oscillator is provided with a transducer element, and a backing mass. The backing mass is acoustically coupled to the transducer element. The at least one membrane extends outward beyond the backing mass to support at least the backing mass within the cavity. The at least one membrane is flexible in an axial direction parallel to the axis of the acoustic transceiver assembly to permit the backing mass to oscillate in the axial direction, and rigid in a transverse direction to restrict lateral movement of the backing mass relative to the housing.

In one aspect, the acoustic transceiver further comprises a rod extending into the transducer element and the backing mass to connect the transducer element and the backing mass together. The rod extending into the transducer element can form a preloading spring providing a bias to the transducer element.

In a further aspect, the transducer element and the backing mass have first and second ends, and include central bores extending between the first and second ends. The rod extends through the central bores of the transducer element and the backing mass.

In another aspect, the backing mass includes a first end and a second end, and a bore extending therebetween, and wherein the at least one membrane includes a first end and a second end, and one or more alignment member extending from the first end and disposed in the bore of the backing mass to align the backing mass with the at least one membrane.

In another aspect, the present invention is directed to an acoustic transceiver assembly including a housing, and an oscillator. The housing has at least one inner wall defining a cavity. The housing has a first end and a second end defining an axis of the acoustic transceiver assembly. The oscillator is provided in the cavity. The oscillator is provided with a transducer element, a backing mass and a rod. The transducer element has a first end, a second end, and a bore extending from the first end toward the second end. The backing mass has a first end, a second end, and a bore extending from the first end toward the second end. The rod is disposed in the bores of the transducer element and the backing mass and connects the transducer element to the backing mass to acoustically couple the transducer element and the backing mass together while also restraining transverse movement of both the transducer element and the backing mass. The rod can form a preloading spring providing a bias to the transducer element. In a further aspect, the rod includes a rod shoulder positioned between the transducer element and the backing mass.

In yet another version, the present invention is a downhole tool including a sensor and a downhole modem. The sensor monitors a downhole parameter and generates an electrical signal indicative of the downhole parameter. The downhole modem comprises transmitter electronics, and an acoustic transceiver assembly. The transmitter electronics is in communication with the sensor and receives a signal indicative of the downhole parameter. The acoustic transceiver assembly comprises a housing, an oscillator, and at least one membrane. The housing has at least one inner wall defining a cavity. The housing has a first end and a second end defining an axis of the acoustic transceiver assembly. The oscillator is provided in the cavity and adapted to generate an acoustic signal indicative of the downhole parameter based upon the receipt of electrical signals from the transmitter electronics. The oscillator comprises a transducer element, and a backing mass. The backing mass is acoustically coupled to the transducer element. The at least one membrane extends outward beyond the backing mass to support at least the backing mass within the cavity. The at least one membrane is flexible in an axial direction parallel to the axis of the acoustic transceiver assembly to permit the backing mass to oscillate in the axial direction, and rigid in a transverse direction to restrict lateral movement of the backing mass relative to the housing.

In yet another aspect, the present invention is a method for making an acoustic transceiver assembly for introducing acoustic signals into an elastic media, such as a drill string or the like, positioned in a well bore. The method includes the steps of forming an oscillator by acoustically coupling a backing mass to a transducer element, and suspending the oscillator in a housing with at least one membrane positioned adjacent to the backing mass.

In a further aspect, the backing mass has a first end and a second end. The step of suspending can be defined further as suspending the oscillator in the housing with at least two membranes with at least one of the membranes being positioned adjacent to the first end of the backing mass and at least another one of the membranes being positioned adjacent to the second end of the backing mass.

In another aspect, the step of suspending can be defined further as suspending the oscillator in the housing with at least one membrane positioned between the backing mass and the transducer element.

In yet another aspect, the present invention is a method for making a downhole modem, comprising the steps of: forming an oscillator by acoustically coupling a backing mass to a transducer element; suspending the oscillator in a housing with at least one membrane positioned adjacent to the backing mass to form an acoustic transceiver assembly; and connecting the transducer element to control electronics suitable for causing the acoustic transceiver assembly to transmit acoustic signals into an elastic media and receive acoustic signals from the elastic media.

In a further aspect, the backing mass has a first end and a second end, and wherein the step of suspending is defined further as suspending the oscillator in the housing with at least two membranes with at least one of the membranes being positioned adjacent to the first end of the backing mass and at least another one of the membranes being positioned adjacent to the second end of the backing mass.

In another aspect, the step of suspending can be defined further as suspending the oscillator in the housing with at least one membrane positioned between the backing mass and the transducer element.

These together with other aspects, features, and advantages of the present invention, along with the various features of novelty, which characterize the present invention, are pointed out with particularity in the claims annexed to and forming a part of this disclosure. The above aspects and advantages are neither exhaustive nor individually or jointly critical to the spirit or practice of the present invention. Other aspects, features, and advantages of the present invention will become readily apparent to those skilled in the art from the following detailed description in combination with the accompanying drawings, illustrating, by way of example, the principles of the present invention. Accordingly, the drawings and description are to be regarded as illustrative in nature, and not restrictive.

BRIEF DESCRIPTION OF THE DRAWINGS

Implementations of the present invention may be better understood when consideration is given to the following detailed description thereof. Such description makes reference to the annexed pictorial illustrations, schematics, graphs, drawings, and appendices. In the drawings.

DETAILED DESCRIPTION

Numerous applications of the present invention are described, and in the following description, numerous specific details are set forth. However, it is understood that implementations of the present invention may be practiced without these specific details. Furthermore, while particularly described with reference to transmitting data between a location downhole and the surface during testing installations, aspects of the present invention are not so limited. For example, some implementations of the present invention are applicable to transmission of data during drilling, in particular measurement-while-drilling (MWD) and logging-while-drilling (LWD). Additionally, some aspects of the present invention are applicable throughout the life of a wellbore including, but not limited to, during drilling, logging, drill stem testing, fracturing, stimulation, completion, cementing, and production.

Figure 1:
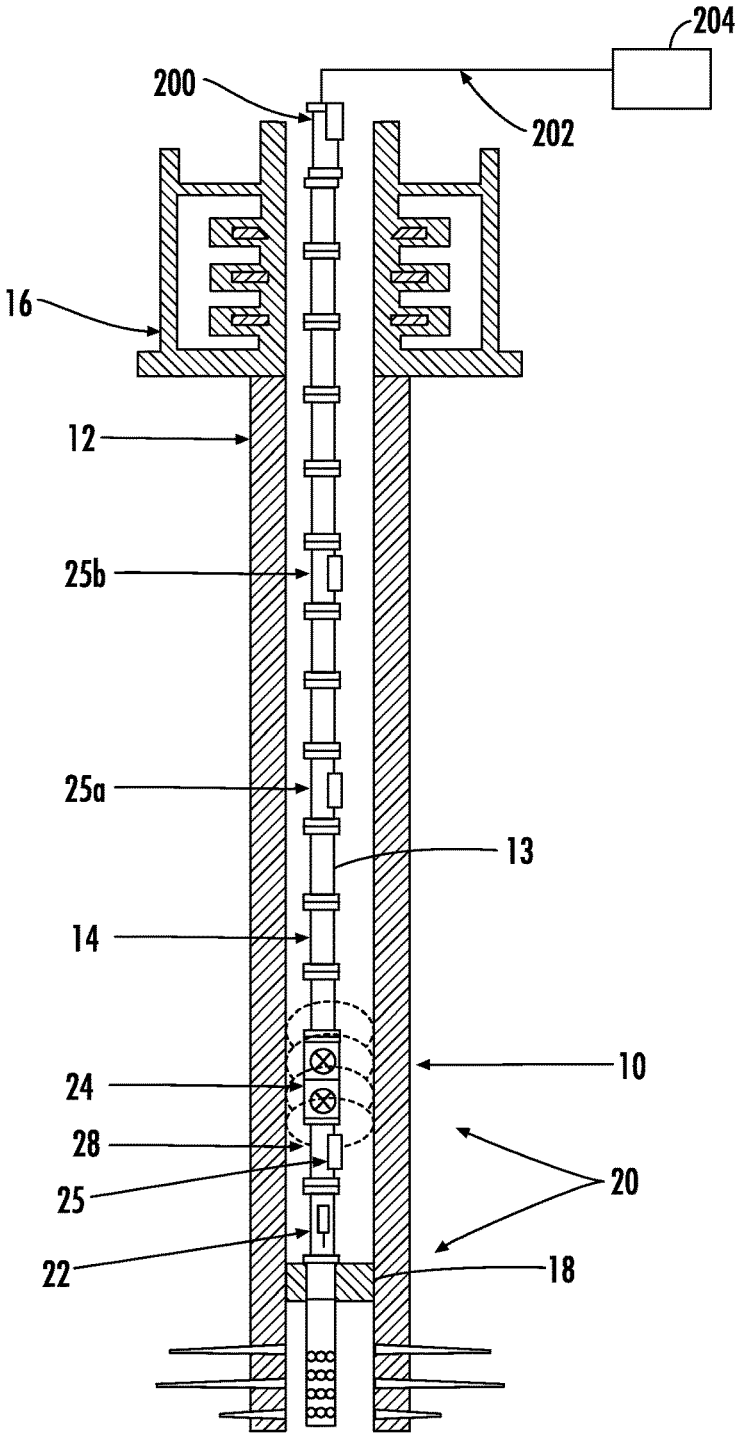
FIG. 1 shows a schematic view of an acoustic telemetry system for use with the present invention.

In particular, however, the present invention is applicable to testing installations such as are used in oil and gas wells or the like. FIG. 1 shows a schematic view of such an installation. Once the well has been drilled, the drilling apparatus is removed from the well and tests can be performed to determine the properties of the formation though which the well has been drilled. In the example of FIG. 1, the well 10 has been drilled, and lined with a steel casing 12 (cased hole) in the conventional manner, although similar systems can be used in uncased (open hole) environments. In order to test the formations, it is necessary to place testing apparatus in the well close to the regions to be tested, to be able to isolate sections or intervals of the well, and to convey fluids from the regions of interest to the surface. This is commonly done using an elastic media 13, such as a jointed tubular drill pipe 14 which extends from the well-head equipment 16 at the surface (or sea bed in subsea environments) down inside the well 10 to a zone of interest. Although the elastic media 13 will be described herein with respect to the drill pipe 14, it should be understood that the elastic media 13 can take other forms in accordance with the present invention, such as production tubing, a drill string, a tubular casing, or the like. The well-head equipment 16 can include blow-out preventers and connections for fluid, power and data communication.

A packer 18 is positioned on the drill pipe 14 and can be actuated to seal the borehole around the drill pipe 14 at the region of interest. Various pieces of downhole equipment 20 for testing and the like are connected to the drill pipe 14, either above or below the packer 18, such as a sampler 22, or a tester valve 24. The downhole equipment 20 may also be referred to herein as a "downhole tool." Other Examples of downhole equipment 20 can include: further packers, circulation valves, downhole chokes, firing heads, TCP (tubing conveyed perforator) gun drop subs, pressure gauges, downhole flow meters, downhole fluid analyzers, Etc.

As shown in FIG. 1, the packer 18 can be located below the sampler 22 and the tester valve 24. The downhole equipment 20 is shown to be connected to a downhole modem 25 including an acoustic transceiver assembly 26 (shown in FIG. 3), which can be mounted in a gauge carrier 28 positioned between the sampler 22 and tester valve 24. The acoustic transceiver assembly 26, also known as an acoustic transducer, is an electro-mechanical device adapted to convert one type of energy or physical attribute to another, and may also transmit and receive, thereby allowing electrical signals received from downhole equipment 20 to be converted into acoustic signals for transmission to the surface, or for transmission to other locations of the drill pipe. In addition, the acoustic transceiver assembly 26 may operate to convert acoustic tool control signals from the surface into electrical signals for operating the downhole equipment 20. The term "data," as used herein, is meant to encompass control signals, tool status, sensed information, and any variation thereof whether transmitted via digital or analog signals.

Figure 2:
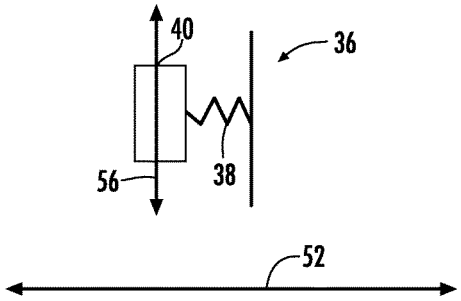
FIG. 2 depicts a schematic diagram of an oscillator constructed in accordance with the present invention as a mass-spring-dampener system.

FIG. 2 illustrates a schematic diagram of an oscillator 36, implementations of which are adapted for placement in or on downhole tools 20, generally, and as part of the acoustic transceiver assembly 26, in particular. The oscillator 36 is shown to include a transducer element 38 and a backing mass 40 calibrated to operate at a particular resonant frequency. As will be discussed in more detail below, the acoustic transceiver assembly 26 also includes a housing 44 (see FIG. 3), and at least one membrane 46 (two membranes designated by the reference numerals 46 and 48 are shown in FIG. 3 by way of example).

The transducer element 38 can be constructed in a variety of manners suitable for converting electrical signals to acoustic signals and also for converting acoustic signals to electrical signals. Examples of suitable transducer elements include a piezoelectric element, a magnetostrictive element or the like. When the transducer element 38 is a piezoelectric element, such element is typically constructed of multiple layers of ceramic material which can be glued together, or held in compression, to thereby create a stack. The glue can be adapted to prevent the layers of the stack from moving side to side relative to each other as in one embodiment the layers must remain in proper alignment for satisfactory performance. However, due to the brittle nature of the typically ceramic, piezoelectric transducer element, and the harsh environment of oilfield technology, prior art methods of protecting the oscillator 36 may be unsatisfactory during transportation and installation of the downhole tools containing the oscillator 36. For example, during lateral movement or shock along an axis 56, the backing mass 40 appears to be mounted as a cantilever, and can generate important constraints on the piezoelectric transducer element 38. In one embodiment, the present invention will solve such problems utilizing the at least one membrane 46, which is flexible in an axial direction 52 parallel to an axis 54 of the acoustic transceiver assembly 26 to permit the backing mass 40 to oscillate in the axial direction 52, and rigid in a transverse direction 56 (approximately normal to the axial direction 52) to restrict lateral movement of the backing mass 40 relative to the housing 44.

Figure 3:
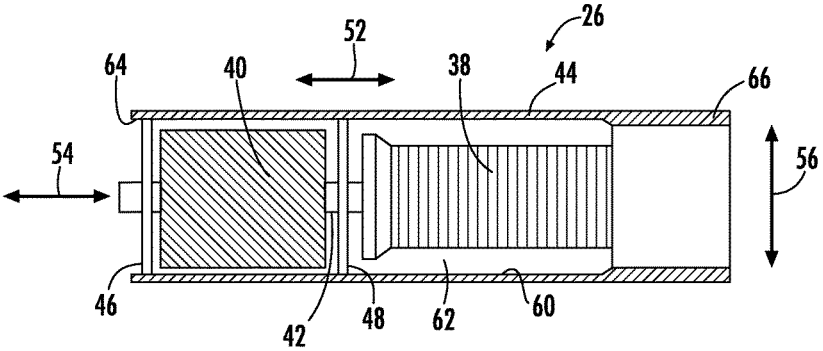
FIG. 3 illustrates an acoustic transceiver assembly constructed in accordance with a preferred implementation of the present invention.

FIG. 3 shows a schematic diagram of the acoustic transceiver assembly 26 in more detail. Although not shown in specific detail, the acoustic transceiver assembly 26 typically functions as both a transmitter and a receiver that share common or discrete circuitry or a single housing although in particular instances the acoustic transceiver assembly 26 may be adapted or used only as a transmitter or a receiver. The housing 44 of the acoustic transceiver assembly 26 may be adapted for placement in a wall, adjacent to a wall, or inside the tubing of downhole equipment 20. The backing mass 40 may be constructed of one or more of a number of different materials, including tungsten, steel, aluminum, stainless steel, depleted uranium, lead, or the like. The backing mass 40 is preferably made from high density material, such as tungsten alloys, steel, and the like and may be of any shape, such as but not limited to, cylindrical, arcuate, rectangular, frusto-conical or square.

The housing 44 is preferably sealed off so as to allow the acoustic transceiver assembly 26 to be maintained at a predetermined pressure, such as atmospheric or vacuumed.

The housing 44 has a least one inner wall 60 to define a cavity 62. The housing 44 has a first end 64 and a second end 66 defining the axis 54 of the acoustic transceiver assembly 26.

The oscillator 36 is provided in the cavity 62 defined by the inner wall 60 of the housing 44. As discussed above, generally, the oscillator 36 is provided with the transducer element 38, and the backing mass 40. In an alternative embodiment, however, the oscillator 36 may include a preloading spring 42. The backing mass 40 is preferably acoustically coupled to the transducer element 38 (i.e., rigidly connected such that the frequency of the backing mass 40 has an impact on the frequency of the transducer element 38), and the preloading spring 42 may be adapted to provide a bias to the transducer element 38 so that the transducer element 38 can be maintained under compression.

In general, the at least one membrane 46, for example, extends outwardly from the backing mass 40 to support the at least one backing mass 40 within the cavity 62 and spaced from the inner wall 60. In general, the at least one membrane 46 is flexible in the axial direction 52 which is parallel to the axis 54 of the acoustic transceiver assembly 26 to permit the backing mass 40 to oscillate in the axial direction 52. The at least one membrane 46 is also constructed to be rigid in the transverse direction 56 to restrict, i.e., limit or reduce, lateral movement of the backing mass 40 relative to the housing 44.

In the example depicted in FIG. 3, the oscillator 36 is provided with two membranes 46 and 48. One of the membranes 46 is provided on one side of the backing mass 40, while the other membrane 48 is positioned on an opposite side of the backing mass 40. Both of the membranes 46 and 48 are of similar size in this example and both of the membranes 46 and 48 are sized so as to form a tight fit with the housing 44 so that the oscillator 36 including the membranes 46 and 48 can be slideably positioned inside the housing 44 while also restricting lateral motion of the oscillator 36 relative to the housing 44. As will be understood by one skilled in the art, the amount of lateral movement permitted between the membranes 46 and 48 and the inner wall 60 of the housing 44 can be on the order of hundreds, or thousands, of an inch or even less depending upon the manufacturing accuracy utilized to manufacture the housing 44 and the membranes 46 and 48. This lateral movement can be reduced to zero by connecting the membranes 46 and 48 and the housing 44, such as by welding the membranes 46 and 48 to the housing 44.

Although in the example depicted in FIG. 3 only one of the membranes 46 and 48 are positioned on either side of the backing mass 40, it should be understood that more than one of the membranes 46 and 48 can be positioned on either side of the backing mass 40 if desired to provide additional support to the oscillator 36. It should also be understood that although the membranes 46 and 48 are depicted in FIG. 3 as being of substantially identical construction, this does not need to be the case. The membranes 46 and 48 can take many forms, and different configurations of the membranes 46 and 48 can be utilized in the same oscillator 36, such as, but not limited to, forming part of the backing mass 40 or located between multiple backing mass 40 (not shown).

Figure 4:
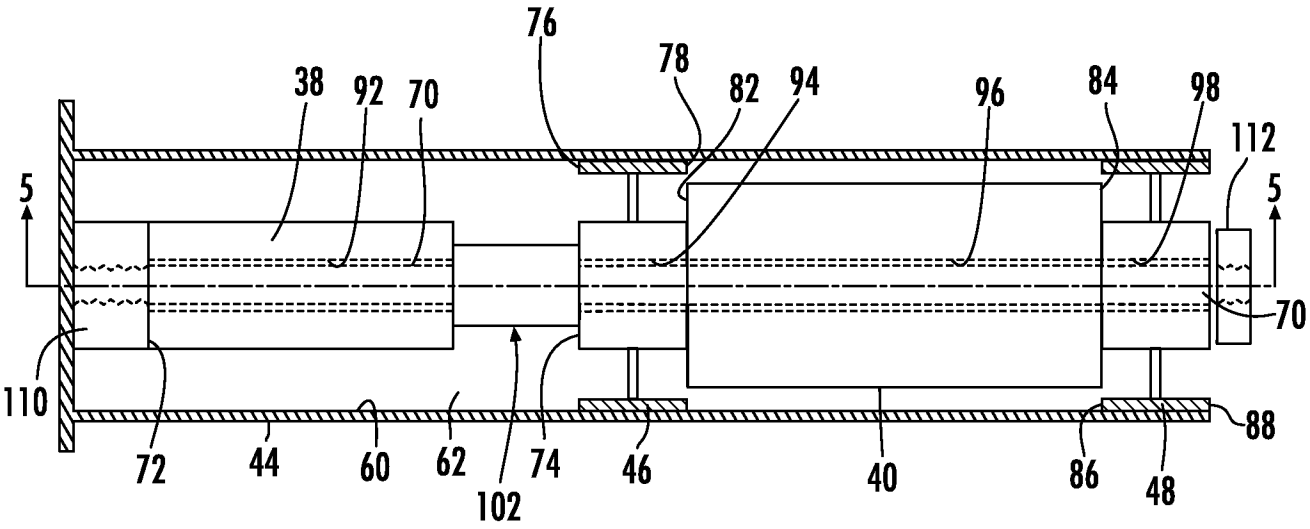
FIG. 4 illustrates an alternate side-elevational/partial cross-sectional view of the acoustic transceiver assembly shown in FIG. 3.
Figure 5:
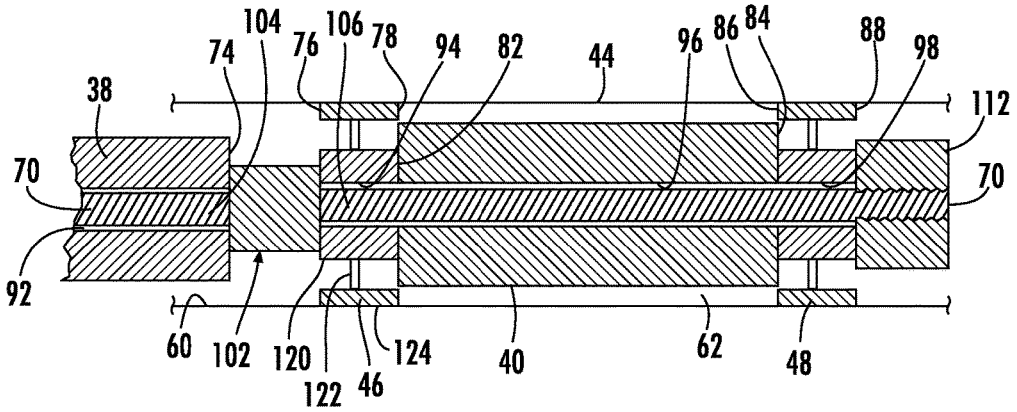
FIG. 5 is a cross-sectional diagram of the acoustic transceiver assembly depicted in FIG. 4 and taken along the lines 5-5 therein.

Referring now to FIGS. 4 and 5, shown therein is a schematic view and a cross-sectional diagram of one version of the acoustic transceiver assembly 26. In particular, the acoustic transceiver assembly 26 as depicted in FIGS. 4 and 5 is further provided with a rod 70 which functions to connect or link the transducer element 38, the backing mass 40, the membrane 46, and the membrane 48 together. In the example depicted in FIGS. 4 and 5, the rod 70 extends into or through the transducer element 38, the membrane 46, the backing mass 40, and the membrane 48. However, it should be understood that the rod 70 may be configured so as to not extend all the way through certain of the transducer element 38, the backing mass 40, the membrane 46 or the membrane 48. For example, the rod 70 could be threaded on one end and adapted to mate with a corresponding threaded member, such as a t-nut positioned inside of the backing mass 40, or the transducer element 38.

In the example depicted in FIGS. 4 and 5, the transducer element 38 has a first end 72, and a second end 74. The membrane 46 is provided with a first end 76 and a second end 78. The backing mass 40 is provided with a first end 82, and a second end 84. The membrane 48 is provided with a first end 86, and a second end 88. The transducer element 38 is also preferably provided with a bore 92 extending from the first end 72 to the second end 74 thereof. The membrane 46 also includes a bore 94 extending between the first end 76 and the second end 78 thereof. The backing mass 40 is provided with a bore 96 which extends from the first end 82 to the second end 84 thereof. The membrane 48 is also provided with a bore 98 that extends between the first end 86 and the second end 88 thereof. In a preferred embodiment, the bores 92, 94, 96 and 98 are positioned centrally within the elements 38, 46, 40 and 48. Further, in the embodiment depicted, the bores 92, 94, 96 and 98 are substantially aligned and maintained in such alignment by way of the rod 70.

To secure the transducer element 38, the membrane 46, the backing mass 40, and the membrane 48 on the rod 70, the rod 70 can be provided with an optional rod shoulder 102 (shown in FIGS. 4 and 5) which has an outer diameter greater than an outer diameter of the remainder of the rod 70. In other words, in one aspect of the present invention, the rod shoulder 102 extends outward from and divides the rod 70 into a first portion 104 and a second portion 106. The transducer element 38 is positioned on the first portion 104 by positioning the first portion 104 through the bore 92 of the transducer element 38. The transducer element 38 can be secured on the first portion 104 of the rod 70 via any suitable means, such as a threaded nut arrangement, compression spring, split ring assembly, or the like. Preferably, the transducer element 38 is maintained on the first portion 104 by way of a nut 110 threaded onto the first portion 104 such that the nut 110 is positioned adjacent to the first end 72 of the transducer element 38, and the second end 74 of the transducer element 38 bears against the rod shoulder 102. In this example, the nut 110 can be adjusted relative to the transducer element 38 to apply tension to the first portion 104 of the rod 70 while also compressing the transducer element 38 to a predetermined state of compression. In this example, the first portion 104 of the rod 70 forms the preloading spring 42 of the oscillator 36. In the example depicted in FIGS. 4 and 5, the membrane 46, the backing mass 40, and the membrane 48 are positioned on the second portion 106 of the rod 70 by disposing the second portion 106 of the rod 70 within the bores 94, 96, and 98. The membrane 46, the backing mass 40 and the membrane 48 can be maintained on the second portion 106 of the rod 70 via any suitable assembly, such as a nut, compression ring, electromagnetic, split ring assembly, hydraulic actuator, or the like. Preferably, the backing mass 40, membranes 46 and 48 are maintained on the second portion 106 by way of a nut 112 threaded onto the second portion 106.

The membranes 46 and 48 should be formed of (or cut from) a rigid material having an elastic behavior such as titanium or steel to permit the oscillator 36 to oscillate without adding extra stiffness or loss. However, to make the acoustic transceiver assembly 26 compact, the backing mass 40 is advantageously made of a high-density alloy, such as tungsten carbide. In the embodiment shown, the rod 70 links the transducer element 38, membranes 46 and 48, and backing mass 40 together utilizing the rod shoulder 102 and a pair of nuts 110 and 112. The nuts 110 and 112 can maintain all of the parts together in a controlled manner and maintained in place using a thread glue or the like. The rod 70 is preferably made of a rigid yet elastic material, such as titanium or steel to form the preloading spring 42. It should also be understood that the rod 70 can be made of one or more separate elements which are connected together including the rod shoulder 102. For example, the rod shoulder 102 can be made as a separate element that has an internal bore which is threaded to receive the first portion 104 and/or the second portion 106.

In order to increase the reliability of the transducer element 38, the radial motion of the various parts of the acoustic transceiver assembly 26 should remain as small as possible. Therefore, close tolerances are preferably used between the outside diameter of the first and second portions 104 and 106 of the rod 70, and the internal diameter of the bores 92, 94, 96, and 98. Other embodiments will be discussed hereinafter using self-centralizing designs for reducing the criticality of the manufacturing precision between the rod 70, and the bores 92, 94, 96, and 98.

As will be discussed in more detail below, the membranes 46 and 48 are preferably constructed similarly, although this does not need to be the case. In general, the membranes 46 and 48 include a hub portion 120, an intermediate portion 122, and a rim 124. Only the elements of the membrane 46 are labeled for purposes of clarity. The hub portion 120 is positioned internally with respect to the other components of the membranes 46 and 48 and is provided with the bores 94 and 98. The intermediate portion 122 is connected to the hub portion 120 and extends outwardly with respect to the hub portion 120 and is constructed so as to be flexible in the axial direction 52 yet rigid in the transverse direction 56. In one embodiment, the hub portion 120 and the intermediate portion 122 are constructed by providing the intermediate portion 122 with a much smaller thickness as compared to the hub portion 120. Other embodiments for achieving the flexibility will be discussed hereinafter such as hub, spoke, and rim arrangement or the like.

Figure 6:
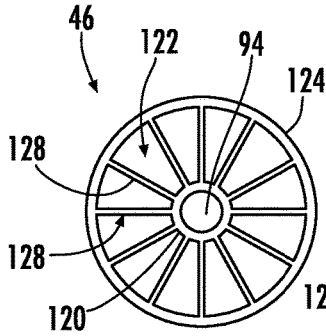
FIG. 6 is a side-elevational view of one version of a membrane constructed in accordance with the present invention.
Figure 7:
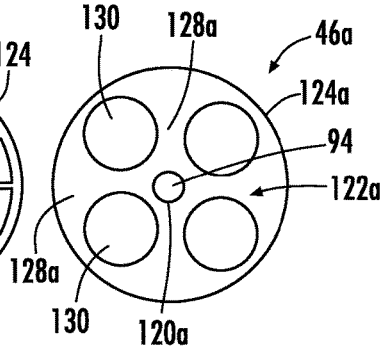
FIG. 7 is a side-elevational view of another version of a membrane constructed in accordance with the present invention.

The rim 124 of the membranes 46 and 48 is connected to the intermediate portion 122 and constructed so as to bear against the inner wall 60 of the housing 44. In one preferred embodiment, the rim 124 is provided with a thickness greater than that of the intermediate portion 122 to increase the stability of the rim 124 relative to the inner wall 60. However, other configurations are also possible. Referring now to FIGS. 6 and 7, shown therein are two examples of the membranes 46 and **46*a* which are constructed in accordance with the present invention. In particular, the membrane 46 depicted in FIG. 6 includes the hub portion 120, the intermediate portion 122, and the rim 124. The hub portion 120 and the rim 124 are formed as tubular elements. The intermediate portion 122, on the other hand, is provided with a plurality of spokes 128 connecting the hub portion 122 to the rim 124. The spokes 128 are designed to provide flexibility in the axial direction 52, while being rigid in the transverse direction 56**.

Shown in FIG. 7 is an alternate embodiment of the membrane 46, which is labeled as **46*a* by way of example. The membrane 46*a* is constructed as a unitary structure and includes a hub portion 120*a*, a rim 124*a*, and an intermediate portion 122*a*. The intermediate portion 122*a* is formed as a thin piece of the material having a variety of holes 130 so as to form spokes 128*a*** there between.

Figure 8:
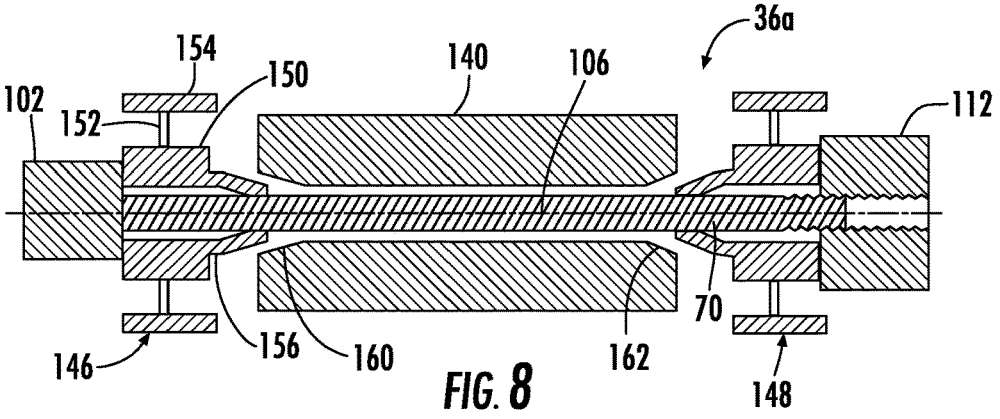
FIG. 8 is a partial, cross-sectional diagram of an alternate embodiment of an oscillator constructed in accordance with the present invention using self-centralizing parts in an untorqued condition.
Figure 9:
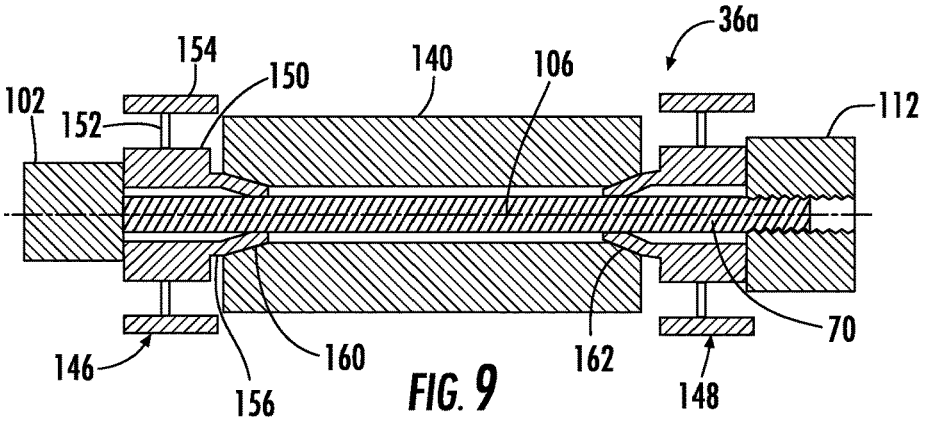
FIG. 9 is a partial, cross-sectional diagram of the alternate embodiment of the oscillator depicted in FIG. 7 in a torqued condition.

Referring now to FIGS. 8 and 9, shown therein is an alternative construction of an oscillator **36*a* constructed in accordance with the present invention. Similar elements are labeled with the same reference numerals as the oscillator 36 described above. As discussed above, in order to increase the reliability of the transducer element 38, the radial motion of the oscillator 36 or 36*a* should remain as small as possible. The drawback of the design depicted in FIGS. 4 and 5 is the small radial gap between the outside diameter of the rod 70, and the inside diameter of the bores 94, 96, and 98. So the tolerances of the backing mass 40, the membrane 46, the membrane 48, and the rod 70 are very important. But a good manufacturing precision increases the cost of the acoustic transceiver assembly 26. In addition, a minimum gap is needed for assembling the various elements, including the transducer element 38, the backing mass 40, the membrane 46, the membrane 48, and the rod 70**.

So, shown in FIGS. 8 and 9 is an improved design utilizing self-centralizing parts that improve the reliability of the oscillator **36*a* relative to the oscillator 36 while reducing its cost. In particular, oscillator 36*a* depicted in FIGS. 8 and 9 is provided with a backing mass 140, and membranes 146 and 148 that are designed to mate together to be self-centralizing. This can be accomplished in a variety of manners and such will be described in detail hereinafter by way of example. It should be noted that all of the other components of the oscillator 36*a* depicted in FIGS. 8 and 9 are the same as that discussed above, with the exception of the self-centralizing construction of the backing mass 140, the membrane 146, and the membrane 148**.

The membranes 146 and 148 are similar in construction. For purposes of brevity only the membrane 146 will be discussed hereinafter in detail. The membrane 146 is provided with a hub portion 150, an intermediate portion 152, and a rim 154 in a similar manner as discussed above with respect to the membrane 46. However, the membrane 146 also includes one or more alignment member 156 extending from the hub portion 150 and designed to be disposed in a bore 158 of the backing mass 140. The backing mass 140 is provided with two relatively large mating surfaces 160 and 162 concentric with the bore 158 to bear against or press on the alignment members 156 of the membrane 146. The alignment member 156 is designed to mate with the backing mass 140 to be self-centralizing. In the embodiment depicted, the alignment member 156 is cone-shaped and the mating surfaces 160 and 162 are chamfers. However, other shapes can be used.

FIG. 8 illustrates the acoustic transceiver assembly 26 having the membranes 146, 148 and the backing mass 140 positioned on the second portion 106 of the rod 70, but prior to tightening of the nut 112 thereto. FIG. 9, on the other hand, is similar to FIG. 8, except that the nut 112 has been tightened so as to compress the backing mass 140 on to the membranes 146 and 148 thereby deforming their alignment members 156. The deformation of the alignment members 156 eliminates any gap between the membranes 146 and 148 and the backing mass 140, even with large manufacturing tolerances. Thus, the alignment members 156 provide a self-centralizing function upon tightening of the nut 112 on to the second portion 106 of the rod 70.

Figure 10:
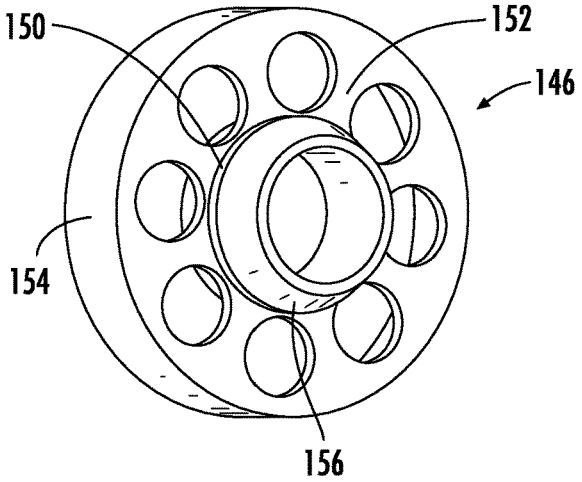
FIG. 10 is a perspective view of an alternate version of a membrane constructed in accordance with the present invention and having a self-centralizing alignment member.

Shown in FIG. 10 is a perspective view of one example of the membrane 146, constructed in accordance with the present invention.

Figure 11:
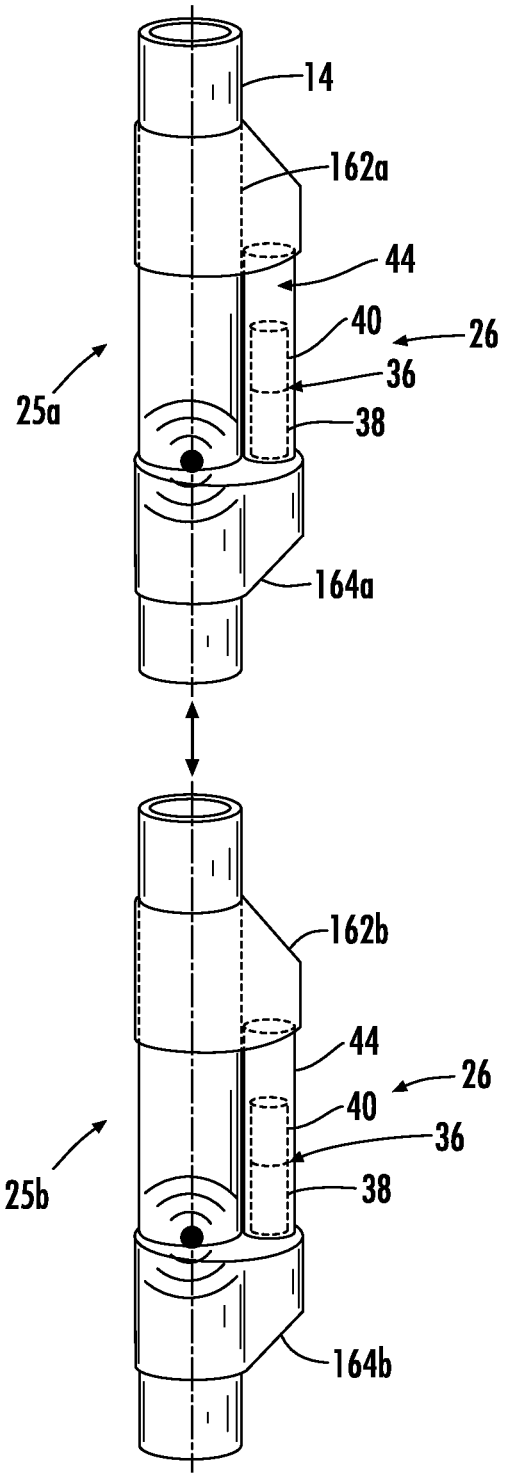
FIG. 11 is a partial schematic view of two downhole modems connected to a drill pipe and communicating with each other in accordance with the present invention.

Referring now to FIG. 11, shown therein is a section of the drill pipe 14 having multiple downhole modems 25 (designated by reference numerals 25*a* and 25*b*) mounted thereto and spatially disposed so as to transmit and/or receive acoustic signals there between via the drill pipe 14. It should be noted that the drill pipe 14 is an example of the elastic media 13 that transmits acoustic or stress signals. The downhole modems 25*a* and 25*b* are shown as being attached to the outside of the drill pipe 14 using a pair of clamps 162 and 164 (which are designated in FIG. 11 as 162*a*, 162*b*, 164*a*, and 164*b*). When actuated by a signal, such as a voltage potential initiated by a sensor, the downhole modem 25 which is mechanically mounted onto the drill pipe 14 imparts a stress wave which may also be now known as an acoustic wave into the drill pipe 14. Because metal drill pipe propagates stress waves, the downhole modems 25*a* and 25*b* including the acoustic transceiver assemblies 26 can be used to transmit the acoustic signals between each other, or to the surface. Furthermore, the downhole modems 25*a* and 25*b* including the acoustic transceiver assembly 26 can be used during all aspects of well site development and/or testing regardless of whether drilling is currently present. It should be noted that in lieu of the drill pipe 14, other appropriate tubular member(s) (elastic media 13) may be used, such as production tubing, and/or casing to convey the acoustic signals.

Figure 12:
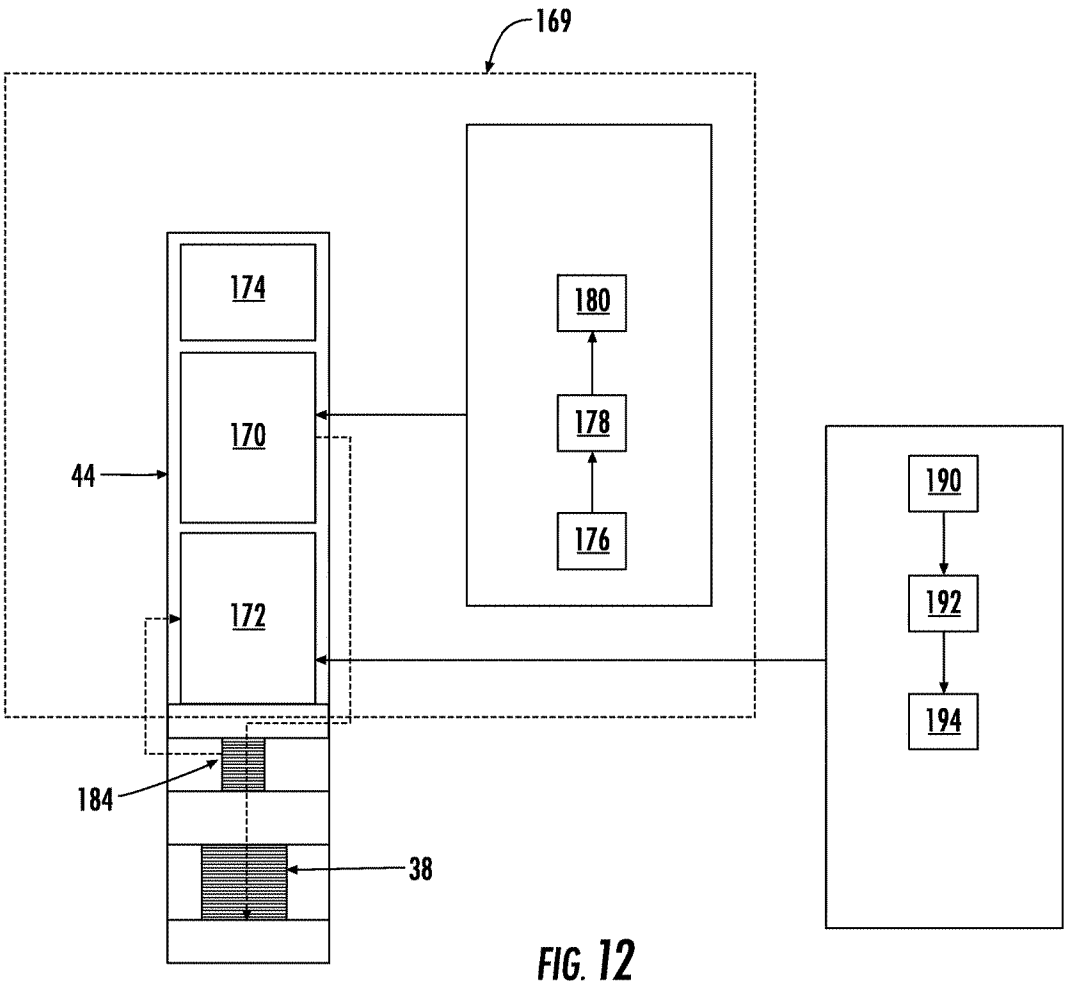
FIG. 12 is a partial block diagram of a modem constructed in accordance with the present invention.

Referring to FIG. 12, the downhole modems 25*a* and 25*b* include control electronics 169 including transmitter electronics 170 and receiver electronics 172. The transmitter electronics 170 and receiver electronics 172 may also be located in the housing 44 and power is provided by means of a battery, such as a lithium battery 174. Other types of power supply may also be used.

The transmitter electronics 170 are arranged to initially receive an electrical output signal from a sensor 176, for example from the downhole equipment 20 provided from an electrical or electro/mechanical interface. Such signals are typically digital signals which can be provided to a microcontroller 178 which modulates the signal in one of a number of known ways such as FM, PSK, QPSK, QAM, and the like. The resulting modulated signal is amplified by either a linear or non-linear amplifier 180 and transmitted to the transducer element 38 so as to generate an acoustic signal in the material of the drill pipe 14.

The acoustic signal that passes along the drill pipe 14 as a longitudinal and/or flexural wave comprises a carrier signal with an applied modulation of the data received from the sensors 176. The acoustic signal typically has, but is not limited to, a frequency in the range 1-10 kHz, and is configured to pass data at a rate of from about 1 bps to about 200 bps. The data rate is dependent upon conditions such as the noise level, carrier frequency, and the distance between the downhole modems 25*a* and 25*b*. A preferred embodiment of the present invention is directed to a combination of a short hop acoustic telemetry system for transmitting data between a hub located above the main packer 18 and a plurality of downhole equipment such as valves below and/or above the packer 18. Either one or both of the downhole modems 25*a* and 25*b* can be configured as a repeater. Then the data and/or control signals can be transmitted from the hub to a surface module either via a plurality of repeaters as acoustic signals or by converting into electromagnetic signals and transmitting straight to the top. The combination of a short hop acoustic with a plurality of repeaters and/or the use of the electromagnetic waves allows an improved data rate over existing systems. The system 10 may be designed to transmit data as high as 200 bps. Other advantages of the present system exist.

The receiver electronics 172 are arranged to receive the acoustic signal passing along the drill pipe 14 produced by the transmitter electronics 170 of another modem. The receiver electronics 172 are capable of converting the acoustic signal into an electric signal. In a preferred embodiment, the acoustic signal passing along the drill pipe 14 excites the transducer element 38 so as to generate an electric output signal (voltage); however, it is contemplated that the acoustic signal may excite an accelerometer 184 or an additional transducer element 38 so as to generate an electric output signal (voltage). This signal can be, for example, essentially an analog signal carrying digital information. The analog signal is applied to a signal conditioner 190, which operates to filter/condition the analog signal to be digitalized by an A/D (analog-to-digital) converter 192. The A/D converter 192 provides a digital signal which can be applied to a microcontroller 194. The microcontroller 194 is preferably adapted to demodulate the digital signal in order to recover the data provided by the sensor 176 connected to another modem, or provided by the surface. Although shown and described as separate microcontrollers 178 and 194, each microcontroller can alternatively be incorporated into a single microcontroller (not shown) performing both functions. The type of signal processing depends on the applied modulation (i.e. FM, PSK, QPSK, QAM, and the like).

The modem 25 can therefore operate to transmit acoustic data signals from the sensors in the downhole equipment 20 along the drill pipe 14. In this case, the electrical signals from the equipment 20 are applied to the transmitter electronics 170 (described above) which operate to generate the acoustic signal. The modem 25 can also operate to receive acoustic control signals to be applied to the downhole equipment 20. In this case, the acoustic signals are demodulated by the receiver electronics 172 (described above), which operate to generate the electric control signal that can be applied to the equipment 20.

In order to support acoustic signal transmission along the drill pipe 14 between the downhole location and the surface, a series of repeater modems 25*a*, 25*b*, etc. may be positioned along the drill pipe 14. These repeater modems 25*a* and 25*b* (see FIG. 1) can operate to receive an acoustic signal generated in the drill pipe 14 by a preceding modem 25 and to amplify and retransmit the signal for further propagation along the drill pipe 14. The number and spacing of the repeater modems 25*a* and 25*b* will depend on the particular installation selected, for example on the distance that the signal must travel. A typical spacing between the modems 25*a* and 25*b* is around 1,000 ft, but may be much more or much less in order to accommodate all possible testing tool configurations. When acting as a repeater, the acoustic signal is received and processed by the receiver electronics 172 and the output signal is provided to the microcontroller 194 of the transmitter electronics 170 and used to drive the transducer element 38 in the manner described above. Thus an acoustic signal can be passed between the surface and the downhole location in a series of short hops.

The role of a repeater modem, for example, 25*a* and 25*b*, is to detect an incoming signal, to decode it, to interpret it and to subsequently rebroadcast it if required. In some implementations, the repeater modem 25*a* or 25*b* does not decode the signal but merely amplifies the signal (and the noise). In this case the repeater modem 25*a* or 25*b* is acting as a simple signal booster.

Repeater modems 25*a* and 25*b* are positioned along the tubing/piping string 14. The repeater modem 25*a* or 25*b* will either listen continuously for any incoming signal or may listen from time to time.

The acoustic wireless signals, conveying commands or messages, propagate in the transmission medium (the drill pipe 14) in an omni-directional fashion, that is to say up and down. It is not necessary for the modem 25 to know whether the acoustic signal is coming from another repeater modem 25*a* or 25*b* above or below. The direction of the message is preferably embedded in the message itself. Each message contains several network addresses: the address of the transmitter electronics 170 (last and/or first transmitter) and the address of the destination modem 25 at least. Based on the addresses embedded in the messages, the repeater modems 25*a* or 25*b* will interpret the message and construct a new message with updated information regarding the transmitter electronics 170 and destination addresses. Messages will be transmitted from repeater modem to repeater modem and slightly modified to include new network addresses.

Referring again to FIG. 1, a surface modem 200 is provided at the well head 16 which provides a connection between the drill pipe 14 and a data cable or wireless connection 202 to a control system 204 that can receive data from the downhole equipment 20 and provide control signals for its operation.

In the embodiment of FIG. 1, the acoustic telemetry system 10 is used to provide communication between the surface and the downhole location. In another embodiment, acoustic telemetry can be used for communication between tools in multi-zone testing. In this case, two or more zones of the well are isolated by means of one or more packers 18. Test equipment 20 is located in each isolated zone and corresponding modems 25 are provided in each zone case. Operation of the modems 25 allows the equipment 20 in each zone to communicate with each other as well as the equipment in other zones as well as allowing communication from the surface with control and data signals in the manner described above.

References in the specification to "one embodiment", "an embodiment", "an example embodiment", etc. indicate that the embodiments described may include a particular feature, structure or characteristic, but every embodiment may not necessarily include the particular feature, structure or characteristic. Moreover, such phrases are not necessarily referring to the same embodiment. Further, when a particular feature, structure, or characteristic is described in connection with an embodiment, it is submitted that it is within the knowledge of one skilled in the art to affect such future, structure, or characteristic in connection with other embodiments whether or not explicitly described.

Embodiments of the present invention with respect to the microcontrollers 178 and 194, and the control system 204 may be embodied utilizing machine executable instructions provided or stored on one or more machine readable medium. A machine-readable medium includes any mechanism which provides, that is, stores and/or transmits, information accessible by the microcontrollers 178 and 194 or another machine, such as the control system 204 including one or more computer, network device, manufacturing tool, or the like or any device with a set of one or more processors, etc., or multiple devices having one or more processors that work together, etc. In an exemplary embodiment, a machine-readable medium includes volatile and/or non-volatile media for example read-only memory, random access memory, magnetic disk storage media, optical storage media, flash memory devices or the like.

Such machine executable instructions are utilized to cause a general or special purpose processor, multiple processors, or the like to perform methods or processes of the embodiments of the present invention.

It should be understood that the components of the inventions set forth above can be provided as unitary elements, or multiple elements which are connected and/or otherwise adapted to function together, unless specifically limited to a unitary structure in the claims. For example, although the backing mass 40 is depicted as a unitary element, the backing mass 40 could be comprised of multiple discrete elements which are connected together using any suitable assembly, such as a system of threads. As another example, although the housing 44 is depicted as a unitary element, it should be understood that the housing 44 could be constructed of different pieces and/or sleeves which were connected together utilizing any suitable technology.

From the above description it is clear that the present invention is well adapted to carry out the disclosed aspects, and to attain the advantages mentioned herein as well as those inherent in the present invention. While presently preferred implementations of the present invention have been described for purposes of disclosure, it will be understood that numerous changes may be made which readily suggest themselves to those skilled in the art and which are accomplished within the spirit of the present invention disclosed.

The invention claimed is:

1. An acoustic transceiver assembly comprising:

a housing having at least one inner wall defining a cavity, the housing having a first end and a second end defining an axis of the acoustic transceiver assembly;

an oscillator provided in the cavity, the oscillator comprising:

a transducer element, and a backing mass acoustically coupled to the transducer element;

a rod extending into the transducer element and the backing mass to connect the transducer element and the backing mass together, wherein the rod forms a preloading spring providing a bias to the transducer element; and at least one membrane extending outward beyond the backing mass to support at least the backing mass within the cavity, the at least one membrane being flexible in an axial direction parallel to the axis of the acoustic transceiver assembly to permit the backing mass to oscillate in the axial direction, and rigid in a transverse direction to restrict lateral movement of the backing mass relative to the housing.

2. The acoustic transceiver assembly of claim 1, wherein the backing mass includes a first end and a second end, and a bore extending therebetween.

3. The acoustic transceiver assembly of claim 2, wherein the at least one membrane has one or more alignment members extending from an end of the at least one membrane and disposed in the bore of the backing mass to align the backing mass with the at least one membrane.

4. The acoustic transceiver assembly of claim 2, wherein the transducer element and the backing mass each have first and second ends, and include central bores extending between the first and second ends of the transducer element and the backing mass, the rod further extending through the central bores of the transducer element and the backing mass.

5. The acoustic transceiver assembly of claim 2, wherein the rod extending into the transducer element is made of titanium.

6. The acoustic transceiver assembly of claim 2, wherein the transducer element comprises a piezoelectric element constructed of multiple layers of ceramic material.

7. An acoustic transceiver assembly comprising:

a housing having at least one inner wall defining a cavity, the housing having a first end and a second end defining an axis of the acoustic transceiver assembly;

an oscillator provided in the cavity, the oscillator comprising:

a transducer element having a first end, a second end, and a bore extending from the first end toward the second end of the transducer element, a backing mass having a first end, a second end, and a bore extending from the first end toward the second end of the backing mass; and a preloading spring adapted to provide a bias to the transducer element, wherein the preloading spring is a rod disposed in the bores of the transducer element and the backing mass, the rod connecting the transducer element to the backing mass to acoustically couple the transducer element and the backing mass together while also restraining transverse movement of both the transducer element and the backing mass.

8. The acoustic transceiver assembly of claim 7, wherein the rod includes a rod shoulder positioned between the transducer element and the backing mass.

9. The acoustic transceiver assembly of claim 7, wherein the rod is made of titanium, and wherein the transducer element comprises a piezoelectric element constructed of multiple layers of ceramic material.

10. A downhole tool comprising:

a sensor for monitoring a downhole parameter and generating an electrical signal indicative of the downhole parameter; and a downhole modem comprising:

transmitter electronics in communication with the sensor and receiving the signal indicative of the downhole parameter; and an acoustic transceiver assembly comprising:

a housing having at least one inner wall defining a cavity, the housing having a first end and a second end defining an axis of the acoustic transceiver assembly;

an oscillator provided in the cavity and adapted to generate an acoustic signal indicative of the downhole parameter based upon receipt of electrical signals from the transmitter electronics, the oscillator comprising:

a transducer element, and a backing mass acoustically coupled to the transducer element;

a rod extending into the transducer element and the backing mass to connect the transducer element and the backing mass together, wherein the rod forms a preloading spring providing a bias to the transducer element; and at least one membrane extending outward beyond the backing mass to support at least the backing mass within the cavity, the at least one membrane being flexible in an axial direction parallel to the axis of the acoustic transceiver assembly to permit the backing mass to oscillate in the axial direction, and rigid in a transverse direction to restrict lateral movement of the backing mass relative to the housing.

11. A method for making an acoustic transceiver assembly comprising:

forming an oscillator by acoustically coupling a backing mass to a transducer element; and suspending the oscillator in a housing by using at least one membrane positioned adjacent to the backing mass or between the backing mass and the transducer element and a rod extending into the transducer element and the backing mass to connect the transducer element and the backing mass together, wherein the rod forms a preloading spring providing a bias to the transducer element, the acoustic transceiver assembly to introduce signals into an elastic media positioned in a well bore.

12. The method of claim 11, wherein the backing mass has a first end and a second end, and wherein the suspending is defined further as suspending the oscillator in the housing with at least two membranes, with at least one of the two membranes being positioned adjacent to the first end of the backing mass and at least another one of the two membranes being positioned adjacent to the second end of the backing mass.

13. The method of claim 11, wherein the at least one membrane extends laterally outward beyond the backing mass to support at least the backing mass within the housing, wherein the at least one membrane has one or more alignment members extending from an end of the at least one membrane and into a bore of the backing mass to align the backing mass with the at least one membrane.

14. A method for making a downhole modem, comprising:

forming an oscillator by acoustically coupling a backing mass to a transducer element;

suspending the oscillator in a housing by using at least one membrane positioned adjacent to the backing mass or between the backing mass and the transducer element to form an acoustic transceiver, and by using a preloading spring adapted to provide a bias to the transducer element, wherein the preloading spring is a rod extending into the transducer element and the backing mass to connect the transducer element and the backing mass together; and connecting the transducer element to control electronics suitable for causing the acoustic transceiver to transmit acoustic signals into an elastic media and receive acoustic signals from the elastic media.

15. The method of claim 14, wherein the backing mass has a first end and a second end, and wherein the suspending is defined further as suspending the oscillator in the housing with at least two membranes with at least one of the two membranes being positioned adjacent to the first end of the backing mass and at least another one of the two membranes being positioned adjacent to the second end of the backing mass.

16. The method of claim 14, wherein the at least one membrane extends laterally outward beyond the backing mass to support at least the backing mass within the housing, wherein the at least one membrane has one or more alignment members extending from an end of the at least one membrane and into a bore of the backing mass to align the backing mass with the at least one membrane.

* * * * *